United States Patent [19]

Johnson

[11] Patent Number: 4,581,927

[45] Date of Patent: Apr. 15, 1986

[54] SELF-CONTAINED BORE HOLE FLOW MEASUREMENT SYSTEM AND METHOD THEREFOR

[75] Inventor: Irvin D. Johnson, Englewood, Colo.

[73] Assignee: Marathon Oil Company, Findlay, Ohio

[21] Appl. No.: 686,513

[22] Filed: Dec. 26, 1984

[51] Int. Cl.[4] ..... E21B 47/00

[52] U.S. Cl. ..... 73/155

[58] Field of Search ..... 73/155; 324/166, 173, 324/178, 179, 172, 206

[56] References Cited

U.S. PATENT DOCUMENTS

| | | | |
|---|---|---|---|
| Re. 28,464 | 7/1975 | Bonnet | 73/155 |
| 2,453,456 | 11/1948 | Piety | 250/260 |
| 2,603,688 | 7/1952 | Cole et al. | 324/172 |
| 2,637,206 | 5/1953 | Atkins, Jr. | 73/155 |
| 3,588,494 | 6/1971 | Mertens | 324/173 |
| 4,314,476 | 2/1982 | Johnson | 73/155 |

*Primary Examiner*—Stewart J. Levy
*Assistant Examiner*—Robert R. Raevis
*Attorney, Agent, or Firm*—Jack L. Hummel; Rodney F. Brown

[57] ABSTRACT

The invention provides a system and method for measuring fluid velocity in well bores. The system and method includes the provision of a plurality of spaced magnetic markers (70) located at predetermined distances (d) along a line (40), a weight (100) connected to one end of the line (40) for holding the line at the bottom of the bore hole, and a basket (110) engaging the line for carrying a self-contained and sealed electronics package (90). When the basket (110) is selectively opened after a predetermined period of time, it flows upwardly at the rate of the fluid carrying the electronics package (90). A sensor (400) in the electronics package (90) detects the position of each magnetic marker (70) on the line (40) and the time elapsed between the detection of each successive markers (70) stored in memory. When the electronics package (90) is removed from the bore hole, the elapsed times stored for each marker (70) are read out and the velocity of the fluids flowing between each magnetic marker (70) is determined.

13 Claims, 11 Drawing Figures

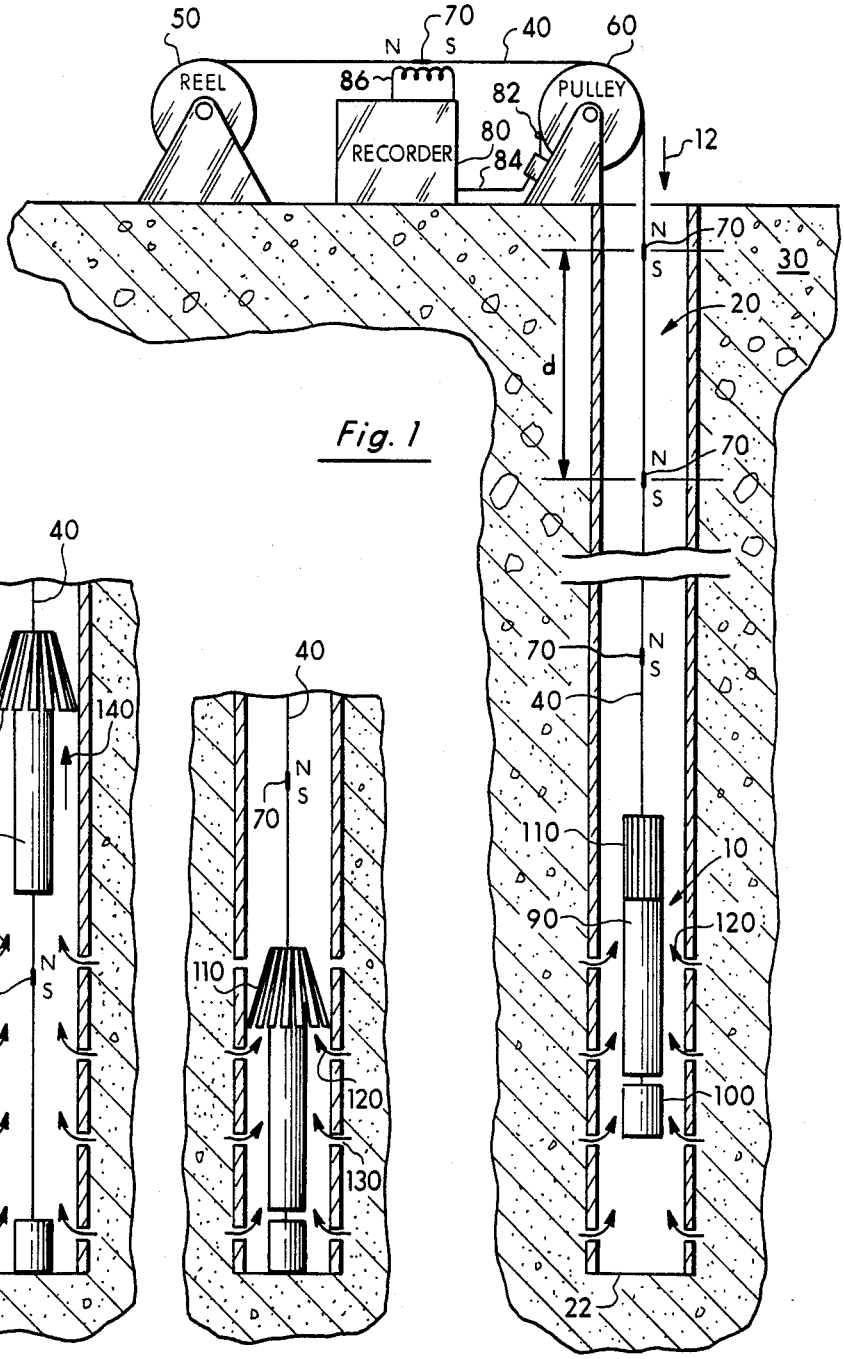
Fig. 1
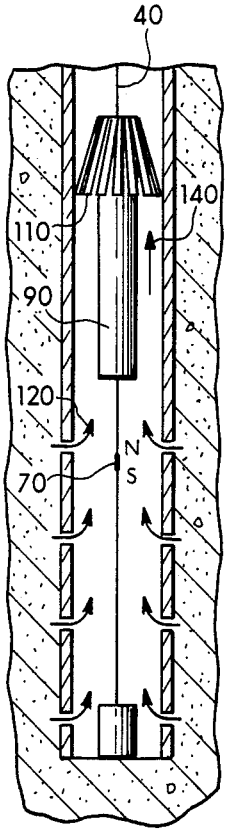
Fig. 3
Fig. 2

SELF-CONTAINED BORE HOLE FLOW MEASUREMENT SYSTEM AND METHOD THEREFOR

BACKGROUND OF THE INVENTION

1. Related Invention

The present invention is related to "An Improved Flaw Basket", Ser. No. 686,514, filed concurrently with this application by the same inventor.

2. Technical Field

The present invention relates to measuring flow rates in bore holes and, more particularly, to a method and apparatus for measuring the flow of fluids moving upwardly in a bore hole from an underlying oil and gas formation.

3. Background Art

It is important to ascertain the flow of fluids in bore holes from different underlying formations so that an indication as to the production of fluid, such as oil or gas, from each different formation can be determined. The present invention is adapted to measure fluid flow in multi-phase fluids in slanted or in vertical bore holes and prior to the application for the present invention, a patentability search was conducted. The results of the patentability search uncovered the following patents:

| Inventor | Reg. No. | Issued |
|---|---|---|
| R. G. Piety | 2,453,456 | Nov. 9, 1948 |
| Jean-Loup Bonnet | Re. 28,464 | July 8, 1975 |
| Irvin D. Johnson | 4,314,476 | Feb. 9, 1982 |

A discussion of conventional prior art devices for measuring fluid velocity of a well bore hole is set forth in U.S. Pat. No. 4,314,476 issued to the inventor on Feb. 9, 1982. The '476 patent relates to a restrictor which is inserted into the bore hole until it reaches a desired depth whereupon the restrictor is expanded. The expanded restrictor is pulled upwardly at a rate sufficient to maintain the differential pressure across the restrictor at zero thereby indicating that the rate that the restrictor is being pulled up is equal to the rate of fluid flow. The '476 invention relates to measurement of fluids that cause stirring action on the fluid velocity sensor.

The 1948 patent Piety (U.S. Pat. No. 2,453,456) relates to an instrument for measuring water flow in wells utilizing a series of vertically spaced geiger counters suspended in the well on a cable. Geiger counters are spaced at predetermined locations. A chamber containing radioactive material is initially positioned above the first geiger counter and then by means of a controlling electric current pulse, is caused to travel downwardly along the cable past each geiger counter. The rate that the chamber falls is controlled by the upward fluid movement of the water from the various formations. A disadvantage, with utilizing the Piety approach, is found in the handling of the radioactive materials which is disclosed primarily as being radon and the like.

The 1975 Bonnett patent is representative of the common "spinner" type flowmeter which utilizes spinners or turbines as the measurement device. Other spinner flowmeters are set forth in the "Background Art" sections of the '476 patent.

DISCLOSURE OF INVENTION

As stated in the inventor's earlier '476 patent, one problem faced in measuring multi-phase fluid velocity, especially in slanted well bore holes, is to formulate a single system and method of fluid velocity measurement which is sensitive for both high and low velocity flows and one whose readings are not affected by the stirring action of the multi-phase fluid and the possible slant of the well bore. Another problem in prior art approaches is found in the delivery of electrical signals upwardly through the bore hole by means of interconnecting cables and the like.

The bore hole flow measurement system and method of the present invention provides a solution to both of these problems by providing a line having a plurality of spaced magnetic markers located at predetermined distances along the line, a weight connected to one end of the line for holding the line at the bottom of the bore hole, and a basket engaging the line for carrying a self-contained and sealed electronics package. The basket and electronics package are initially oriented at the bottom of the bore hole and then, after a predetermined time, the basket activates and moves upwardly along the line being pushed by the flow of fluids from the underlying formations in the bore hole. A sensor in the sealed electronics package detects the position of each magnetic marker on the line and the time elapsed between the detection of each successive marker is stored in memory. When the sensing and storing is completed for each magnetic marker, the electronics package is removed from the bore hole and the elapsed time data stored for each location (i.e., each magnetic marker along the line) is read out so that the velocity of the fluids flowing between each magnetic marker can be determined.

A disadvantage of each of the above prior art systems resides in the fact that electronic or electrical cables must be placed in the bore hole to communicate with or receive signals from the particular sensor involved. The present invention solves this problem by providing a self-contained electronic package with no electronic or electrical connection to instrumentation on the surface as the measurements are being obtained.

BRIEF DESCRIPTION OF DRAWING

The details of the present invention are described in the accompanying drawing:

FIG. 1 sets forth an illustration showing the lowering of the self-contained bore hole flow measurement system of the present invention into a bore hole;

FIG. 2 sets forth an illustration showing the placing of the self-contained bore hole flow measurement system of the present invention at the bottom of the bore hole;

FIG. 3 sets forth an illustration showing the lifting of the self-contained electronic housing upon the opening of a basket restrictor;

GENERAL DESCRIPTION

Figure 4:
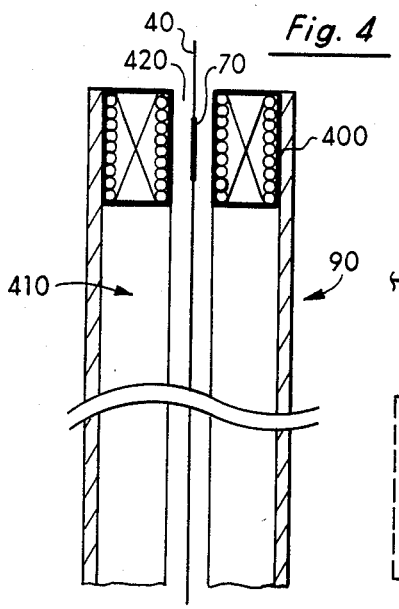
FIG. 4 is a side cut-away view of the self-contained electronic housing of the present invention showing the sensor of the present invention.

The general method and operation of the present invention is set forth in the illustrations of FIGS. 1–3. The tool 10 of the present invention is lowered in the direction of arrow 12 downwardly into a well bore hole 20 formed in the earth 30. The tool 10 of the present invention is lowered until it hits the bottom 22 of bore hole 20, as shown in FIG. 2 or until it is located below the producing formations desired to be measured. The tool is lowered on a slick or conductor line 40 which is dispensed from a motorized reel 50 and is oriented into the bore hole 20 by means of a mechanical device such as a pulley 60. The wire line 40 has a number of indicators such as magnetic markers 70 spaced at predetermined constant intervals, d. The intervals in the preferred invention could be at any convenient spacing depending on the depth of the bore hole 20 such as from one foot to thirty feet. The markers 70 are placed on the wire line 40 either at a remote location or in the field by means of a magnetic recorder 80. The magnetic recorder 80 receives distance signals from an odometer 82 over line 84 and imprints the marker 70 by means of an electromagnet 86.

The tool 10 of the present invention includes an electronic housing 90, a weight 100, and a collapsible basket or pig 110. The basket 110 is fully disclosed in the above identified related patent application entitled "An Improved Flow Basket." The weight 100 is sufficient to hold the wire line 40 at the bottom of the bore hole 22 below the underlying producing formations and, after placement on the bottom, the basket 110 is timed open and to restrict the well flow 120. The well flow 120 enters the bore hole 20 through perforations 130 from oil bearing formations.

As shown in FIG. 2, the basket 110 opens outwardly to restrict the well flow 120 and, as shown in FIG. 3, the basket 110 carrying the electronic housing 90 is lifted upwardly in the direction of arrow 140. The electronics are self-contained in the housing (90) and are impervious to the fluids being completely functional in the high temperatures found at such depths. As will be explained more fully, the basket 110 and the electronic housing 90 operatively slide over the wire line and are capable of traveling up the wire line 40 towards the surface. As the electronic housing 90 connected to the bottom of the basket 110 travels upwardly, a sensor contained therein detects each magnetic marker 70. Because each magnetic marker 70 is separated by the predetermined distance, d, the electronic housing 90 contains the circuitry necessary to measure the elapsed time it takes the housing 90 to travel from each marker 70 to the next successive marker 70 and can, thereby, form a data base from which the velocity of the fluid flow 120 between adjacent markers can be determined.

As mentioned, the electronic housing 90 is self-contained and stores all the data concerning the times between each adjacent markers 70 and only when the housing 90 is recovered from the bore hole 20 is its output read. Because the electronics contained in housing 90 access significant well depths, the electronics contained therein must be designed to withstand temperatures of approximately 250 to 270 degrees F. Furthermore, the electronics is capable of storing information concerning, in the preferred embodiment, at least five hundred and twenty markers 70. No connecting electrical wires between the housing and the surface are required under the teachings of this invention resulting in a considerable cost and labor savings.

In summary, it can be observed that the velocity measurement tool 10 of the present invention can be rapidly lowered into conventional straight or slanted bore holes 20 to rest on the bottom 22 thereof. After a predetermined time delay, the restrictive pig or basket 110 is opened, as shown in FIG. 2, and, under pressure of the fluid flow 120 flowing from the formation, the basket 110 carrying the electronics package 90 is lifted upwardly in the direction of arrow 140 at a velocity corresponding to the velocity of the fluid flow 120. As the flow increases along the bore hole 20 by means of production from oil bearing formations, the elapsed time between adjacent markers 70, spaced at a constant predetermined distance, d, from each other, can be determined, stored internally, and read out upon recovery from the bore hole 20. Given the elapsed time, the value of the predetermined distance, d, and the casing diameter it is routine to determine the flaw of the fluids between successive markers.

It is to be expressly understood that indicators other than magnetic such as collars and collar locators as well as other types of releasable pigs or basket restrictions could be utilized under the teachings of the present invention which relates to the method of placing a line carrying the indicators (70) at predetermined distances, d, in the bore hole, moving a sensor upwardly along the line under force of the fluids, and storing the elapsed times between the detection of each adjacent indicator by the sensor in the self-contained housing without the use of interconnecting cables.

BEST MODE FOR CARRYING OUT THE INVENTION

Figure 5:
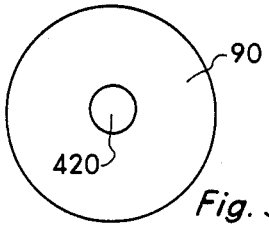
FIG. 5 is a top view of the housing of FIG. 4.

The details of the electronic housing are shown in FIGS. 4 and 5 to include a magnetic pick-up coil 400 located at the top of the housing 90 and the container 410 for holding the electronics of the present invention. The overall housing 90 is cylindrical in shape having a center formed longitudinal hole 420 extending the entire length of housing 90. As shown in FIG. 4, the longitudinal hole 420 rides along, and is guided by, the wire line 40. Housing 90 is a water proof container capable of withstanding high pressures. The actual construction of housing 90 is conventional and may include a number of different configurations.

Figure 5A:
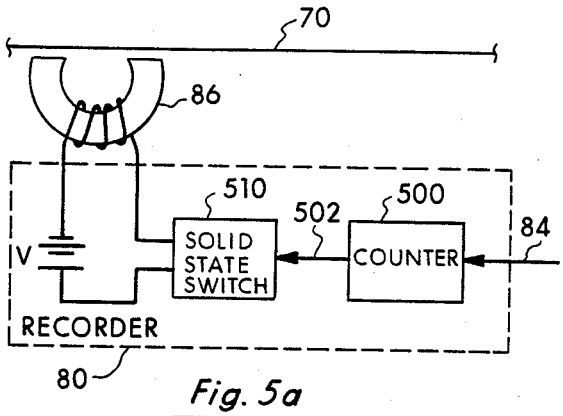
FIG. 5*a* is a block diagram schematic of the recorder 80 of FIG. 1.

The details of the magnetic recorder 80 are shown in FIG. 5*a* to include the electromagnet 86 for imprinting the markers 70 at predetermined distances, d, along wire 70. The distance signals are delivered on lead 84 from the odometer 82 into a counter circuit 500. Counter circuit 500 can be preselected to a desired distance such as one foot to thirty feet or other suitable distance interval. Whenever the selected distance is counted a signal is delivered over line 502 to a solid state switch 510 which becomes activated to place a voltage such as +V across the electromagnet 86 to mark the wire 70.

Figure 6:
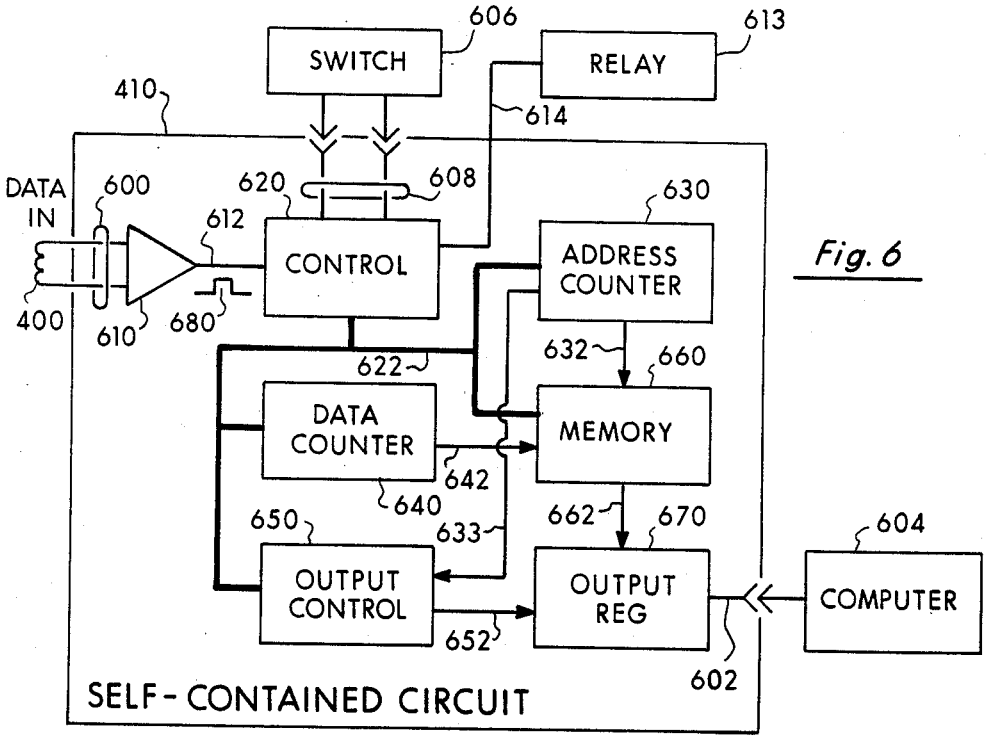
FIG. 6 is a block diagram of the electronics contained in the self-contained circuit of the present invention.

The block diagram of the self-contained circuit 410 is shown in FIG. 6. The self-contained circuit 410 of the present invention receives input data from the magnetic pick-up 400 over leads 600 and outputs data over bus 602 into a computer 604. A relay 613 is selectively activated after a preset time has elapsed over lead 614 to open the basket 110. The self-contained circuit 410 is manually controlled through a switch 606 accessing the circuit over lines 608. The switch 606 essentially places the self-contained circuit 410 in either the WRITE mode (for the acquisition of data) or in the READ mode (for the outputting of data into computer 604). The selection of these two states is made when the self-contained under 410 is on the surface of the earth and out of the bore hole 20. Hence, prior to lowering of the housing 90 into the bore hole 20, the switch 606 is plugged into the self-contained circuit 410 and sets the circuit into the WRITE mode. When the housing 90 is retrieved from the bore hole, the switch 606 is again plugged into the circuit 410 and the circuit is placed in the READ mode. At that time, the computer 604 is plugged into the circuit 410 and the data is read from the circuit 410 into computer 604.

The self-contained circuit 410 includes an operational amplifier 610 for amplifying the signals from the magnetic pick-up 400 appearing on lines 600. The output of the amplified signal is delivered over line 612 to a control circuit 620. The control circuit 620 controls an address counter 630, a data counter 640, an output control circuit 650 and the memory 660 all over bus 622. The address counter 630 accesses a memory 660 over lines 632, and the data counter 640 also accesses memory 660 over lines 642. Finally, an output register 670 is connected over lines 662 with the memory circuit 660 and over lines 652 to the output control 650.

In operation, the self-contained circuit 410 functions as follows. In the WRITE mode, whenever a magnetic marker 70 is detected by the magnetic pick-up coil 400, a positive going pulse 680 is delivered on line 612. With the advent of pulse 680, the control 620 activates the data counter 640 to start counting clock pulses at a fixed frequency. The total count stored in data counter 640 between adjacent pulses 680 represents the amount of time the housing 90 has traveled from a first magnetic marker 70 to a second magnetic marker 70 over the predetermined distance, d. Hence, every time a marker 70 is detected, the control 620 causes an address counter 630 to be incremented and the time between adjacent pulses stored in data counter 640 is then transferred into memory 660 at that address location. In this fashion, the amount of time between adjacent pulses is accurately stored for each individual pulse in memory 660.

When the tool 10 completes its journey and travels to the surface of the bore hole 20, the self-contained circuit 410 is removed, the switch 606 inserted, the computer 604 interconnected and the READ mode is entered. At this point, the control 620 activates the output control 650 and causes the output register 670 to read each memory location in parallel and to output that information over lines 602 in serial protocol to computer 604. Hence, the entire contents of the memory 660 for each marker location are read out and delivered into computer 604.

Figure 7:
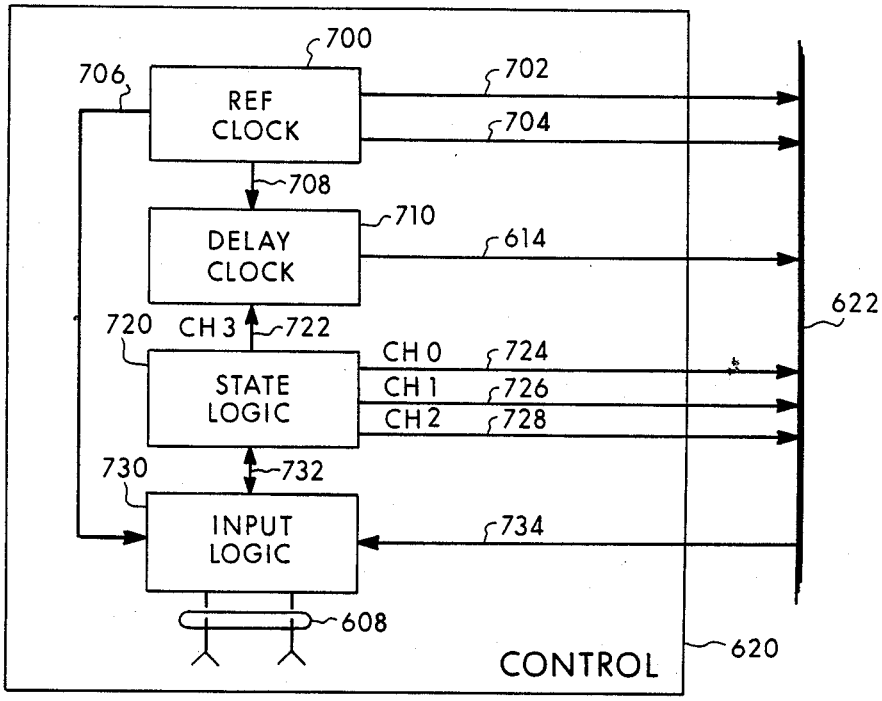
FIG. 7 is a block diagram of the control circuit of the present invention.
Figure 8:
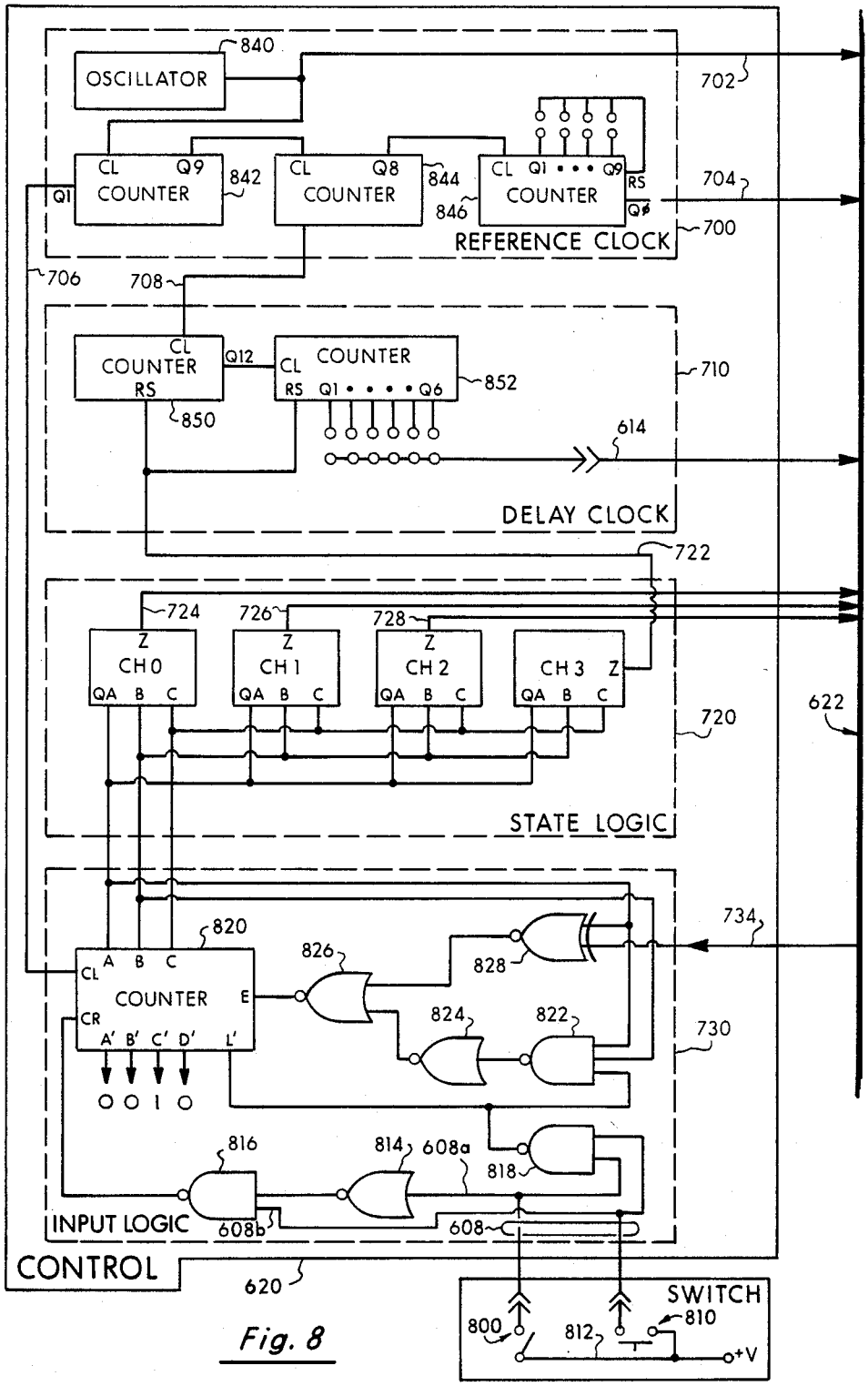
FIG. 8 is a schematic of the control circuit of FIG. 7.

The details of the control circuit 620 and the switch 606 as shown in FIG. 6 are set forth in FIGS. 7 and 8. The switch 606 is composed of an on/off (READ-WRITE) switch 800 and a momentary switch 810. One contact from each switch 800 and 810 is tied together over line 812 to a voltage source, +V. The momentary switch 810 is normally open. The other contacts of switch 800 and 812 are connected over lines 608 to the control 620. In particular, line 608*a* is connected through NOR gate 814 which in turn is connected to one input of NAND gate 816. Line 608 is also connected to the input of NAND gate 818. Line 608*b* is connected to the second input of NAND gate 816 and is further connected to the second input of NAND gate 818. The output of NAND gate 816 is delivered to the clear CR input of a four bit counter circuit 820. The output of NAND gate 818 is delivered to the load L' input of counter 820. The output of NAND gate 818 is further delivered to the input of NAND gate 822. The output of NAND gate 822 is delivered to the single input of NOR gate 824 which inverts the signal and delivers it to the input of NOR gate 826. The output of NOR gate 826 is delivered to the enable E input of counter 820. Finally, an exclusive-or gate 828 receives an input over lead 734 from the control bus 622 and is connected to the second input of NOR gate 826. Output A of counter 820 is delivered back as an input to exclusive-or gate 828 and further to the input of NAND gate 822 whereas output B of counter 820 is delivered back to the third and remaining input of NAND gate 822. The counter 820 is preferably Model No. CD40161BF and is conventionally available from RCA, 2784 North Speer Boulevard, Suite 346, Denver, Colo. 80211 (Catalog SSD-250B).

The operation of input logic circuit 730 will now be discussed. Assuming that it is desired to READ the information contained in the memory 660, the switch 800 is closed to provide a high signal to line 608*a*. At this time, the signal on lead 608*b* is low. Therefore, the two inputs to NAND gate 816 are low and the output of NAND gate 816 is high. Likewise, the output of NAND gate 818 is high. Pushing the momentary switch 810 momentarily provides a high signal on line 608*b* which causes the output of NAND gate 818 to change from a high to a low signal. The output of NAND gate 816, in a low to high transition (i.e., when switch 800 is turned on), clears counter 820 and the output of NAND gate 818, in a high to low transition (i.e., when monetary switch 810 is pushed), loads the counter with a preset value. The preset value is shown to be for DCBA, 0100 so that the output of counter 820 for only CBA is 100. Since the B and A outputs of counter 820 are connected back to the remaining two inputs of NAND gate 822, all three inputs to NAND gate 822, at this time (i.e., after the monetary switch 810 is released), are low causing the output to go high and the output of inverter 824 to go low.

As will be explained subsequently, at this time, the remaining input to NOR gate 826 from gate 828 is low and the output of NOR gate 826 is high which enables the counter 820 to start counting the clock pulses coming in on lead 706 from the reference clock. As will be subsequently explained, the frequency of these clock pulses is preferably sixty Hertz. At this time, the remaining input over lead 734 to exclusive-or gate 828 is high causing the output to be low.

In the READ state, the following logic states are provied at the output of counter 820:

TABLE I

| CBA |
|---|
| 100 |
| 101 |
| 110 |
| 111 |

As can be witnessed, four binary logic states are provided.

In the WRITE mode of operation, the input logic circuit 730 functions as follows. The switch 800 is left open thereby maintaining a low on line 608*a*. The presence of a low on line 608*a* holds the output of NAND gate 818 high regardless of the status of the momentary switch 810. At this time, the output of inverter 814 is high. When the momentary switch 810 is pushed, a high signal is delivered on line 608*b* and the presence of two high inputs to NAND gate 816 causes the output to go low thereby clearing the counter 820 to all zeros. Because the B, A output of counter 820 is low, NAND gate 822 is held high and the output of inverter 824 is low. As will be subsequently explained, the second input to NOR gate 826 is also low so that the output of NOR gate 826 is high thereby enabling the counter to count the clock pulses on lead 706. At this time, the input over line 734 is high so that the output of exclusive-or circuit 828 is low.

Hence, the following four binary logic states are provided for the WRITE mode:

TABLE II

| CBA |
|---|
| 000 |
| 001 |
| 010 |
| 011 |

Therefore, there are four binary logic states for the WRITE mode and four for the READ mode and these four binary states are delivered into the control logic circuit 720 over lines 732 as shown in FIG. 8.

The control logic circuit 720 is comprised of four integrated circuit chips, Model No. MC14512AL which are conventionally available from Motorola Corp., Phoenix, Ariz. Essentially, these chips, channels numbers CHO through CH3 decode the logic states of Tables I and II above as follows:

TABLE III

| | | Channel | | | | |
|---|---|---|---|---|---|---|
| MODE | CBA | 3 | 1 | 0 | 1 | Function |
| READ | 100 | 1 | 1 | 0 | 1 | Reset |
| | 101 | 1 | 1 | 1 | 0 | Read |
| | 110 | 1 | 1 | 0 | 0 | NOP |
| | 111 | 1 | 1 | 0 | 0 | NOP |
| WRITE | 000 | 1 | 1 | 0 | 1 | Reset |
| | 001 | 1 | 0 | 1 | 0 | Write all "O"s |
| | 010 | 1 | 1 | 0 | 1 | Reset |
| | 011 | 0 | 0 | 0 | 0 | Start |

These control logic values will be discussed in the ensuing discussion.

Also present in the controls 620 of FIG. 8 is a reference clock 700 which includes an oscillator 840 which delivers a 600 Hz clock pulse, in the preferred embodiment, over lines 702. Connected to the oscillator 840 is a series of decade counters 842, 844, and 846. Each of these decade counters are preferably Model No. CD4017AL and are manufactured by RCA. The oscillator 840 is preferably Model No. C13R3H1 manufactured by The Connor-Winfield Corp., West Chicago, Ill. 60185. The last decade counter 846 is capable of being selectively modified to change the reference clock pulses appearing on line 704 in a range from 0.16 seconds to 1.5 seconds. In the preferred embodiment, the pulse rate on the reference clock line 704 is one second. As shown in FIG. 8, the first decade counter 842 delivers a 60 Hz (divide by 10) pulse over line 706 to the input logic circuit 730. Additionally, a 6 Hz pulse is delivered over line 708 to the delay clock circuit 710 from the second decade counter 844.

The delay clock circuit 710 receives the 6 Hz pulses on line 708 in the twelve-stage counters 850 and 852. In the preferred embodiment, each twelve-stage counter 850 and 852 is preferably a Model No. CD4040AL and is conventionally available from RCA. The second twelve-stage counter 852 can be selectively adjusted under the teachings of the present invention to provide a delay trigger pulse on line 614 varying from twenty-two minutes to seven hundred and twenty minutes. The twelve-stage counters 850 and 852 are reset over line 722 by channel three, CH3, of the control logic 720.

As mentioned, the delay clock circuit 710 functions as follows. The reference back to FIGS. 1 through 3, the tool 10 of the present invention is placed in the WRITE mode and the delay clock 710 is suitably set for a proper time delay from twenty-two minutes to 720 minutes. The amount of delay depends on the depth of the bore hole 720. The delay should be sufficient to allow the tool 10 of the present invention to be fully lowered into the bore hole 20 until it rests on the bottom. After resting on the bottom, the trigger pulse on lead 614 is issued to activate relay 613 causing the basket 110 to open up as shown in FIG. 2.

Figure 9:
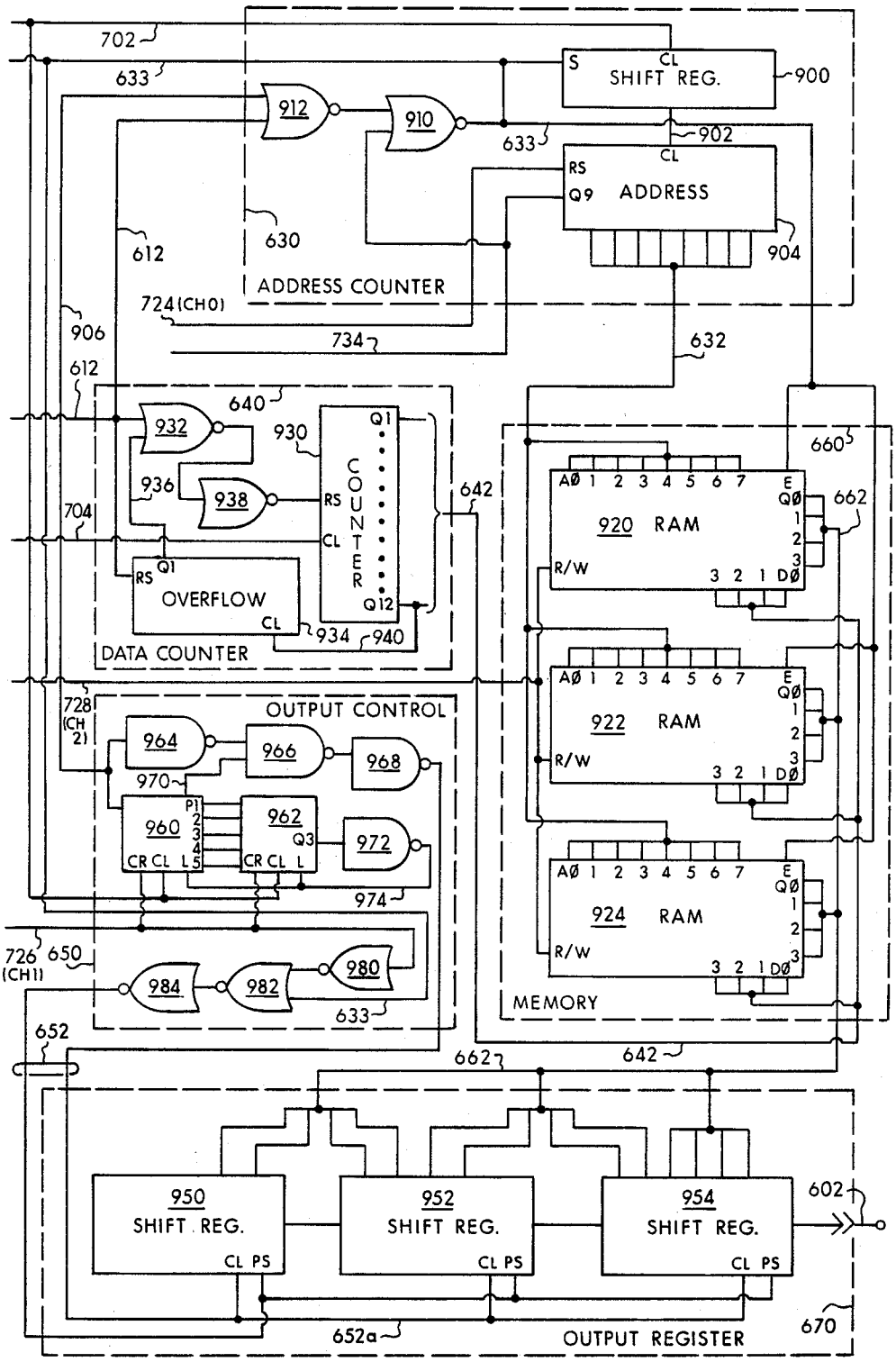
FIG. 9 is a schematic of the remaining circuits of the present invention.

In FIG. 9 are set forth the details of the remaining circuitry for the address counter 630, the data counter 640, the output control 650, the memory 660, and the output register 670, of FIG. 6. The address counter 630 includes an eight-stage shift register 900 interconnected over lines 902 to a twelve-stage counter 904. The eight-stage shift register is preferably Model No. CD4021AF manufactured by RCA. The twelve-stage counter 904 is preferably Model No. CD4040AL manufactured by RCA.

The shift register 900 functions to delay the address counter clock line pulse on line 633 by eight clock cycles. The counter 904 is reset by channel CH0 of the control logic 720 over line 724. The generation of the 15 Hz pulse on lead 906 will be discussed with the explanation of the output control circuit 650 subsequently. The Q9 output of the twelve-stage counter 904 on line 734 is normally low thus enabling NOR gate 910. NOR gate 910 receives a second input from the output of NOR gate 912. NOR gate 912 receives as one of its inputs the wire line pulses 680 on line 612 and the second input is the 15 Hz pulse on lead 906. Hence, whenever a magnetic marker 70 is detected, a high signal appears on lead 612 which then goes low until the detection of the next pulse 680 which is delivered through NOR gate 910 to the memory circuit 660 and to the output control circuit 650.

In operation, the address counter 630 functions to increment the address in counter 904 upon the detection of each magnetic marker pulse 680 on line 612. The enabled high signal on line 633 (when pulse 680 is present), accesses the memory 660 to enable the memory to read in the next address appearing in counter 904 over leads 632. The eight clock cycle delay between the enabled pulses is necessary to first enable the memory signal 660 and then to read the new address out of counter 904. The memory circuit 660 is composed of three random access memories (256×4) chips 920, 922, 924 preferably Model Nos. HM6551-8 manufactured by Harris Semiconductor, P.O. Box 883, Melbourne, Fla. 32901.

The RAMS 920, 922, 924 receive their address inputs over lines 632 from the address counter 630, the data corresponding to the number of clock pulses between magnetic markers 70 is delivered over lines 642 from the data counter 640 and stored in RAMS 920, 922, and 924. In the READ mode, the data stored at each address location is delivered over lines 662 to the output register 602. As indicated in FIG. 9, the selection of READ/-WRITE modes for the memory 660 is delivered over leads 728 from channel two CH2 of the state logic 720.

The data counter circuit 640 utilizes a twelve-stage counter 930 which is preferably on RCA Model No. CD4040AL. NOR gate 932 receives the magnetic marker pulse 680 over line 612 as one of its inputs and further receives a signal from the twelve-stage counter 934 over line 936. Normally line 936 is held low (enabled) so that any low signal (i.e., the time between successive pulses 680) appearing on lead 612 is transmitted through NOR gate 932 as a high signal and inverted by NOR gate 938 into a low signal. A low signal appearing at the output of inverter 938 resets the twelve-stage counter 930. Hence, when both inputs to NOR gate 932 are low, a low pulse appears at the output of 938 to reset the counter 930. Hence, with the detection of each positive going wire marker pulse 680, the counter 930 is reset by the positive to negative transition. With the counter 930 reset to zero, until the detection of the magnetic pulse 680, the counter 930 is incremented over line 704 from the reference clock. Counter 934 serves as an overflow and in the event the count is too high in counter 930, a signal is generated over lead 940 which causes lead 936 to go high thereby disabling gate 932 so that additional magnetic pulses simply are not counted. The overflow counter 934 is reset with the next magnetic pulse.

The next magnetic pulse from line 612 resets the counter 934 thereby enabling counter 930. As soon as the counter 934 receives the overflow count from the Q12 output of counter 930, the counter 930 is gated off through line 936 to the NOR gate 932 and further counting is disabled. The output register circuit 670 includes three eight-stage shift register chips 950, 952 and 954. These shift registers are conventionally available as Model No. CD4021AL and are available from RCA. These shift registers 950, 952 and 954 receive data, in parallel, over lines 662 from memory 660 and shift that data out in serial form over line 602 to computer 604. The control for this parallel-to-serial shifting is performed by the output control 650 over leads 652. The shift registers 950, 952, and 954 are connected as follows to provide twelve bits of data, D, according to a standard RS232c serial protocol:

TABLE IV

| | | | | | | | | |
|---|---|---|---|---|---|---|---|---|
| | | | REG 954 | | | | | |
| PIN | 8 | 7 | 6 | 5 | 4 | 3 | 2 | 1 |
| | (H) | (L) | D | D | D | D | D | D |
| | | | 1 | 2 | 3 | 4 | 5 | 6 |
| | | | REG 952 | | | | | |
| PIN | 8 | 7 | 6 | 5 | 4 | 3 | 2 | 1 |
| | (L)* | (H) | (H) | (L) | D | D | D | D |
| | | | | | 7 | 8 | 9 | 10 |
| | | | REG 950 | | | | | |
| PIN | 8 | 7 | 6 | 5 | 4 | 3 | 2 | 1 |
| | D | D | (L)* | (H) | — | — | — | — |
| | 11 | 12 | | | | | | |

The designation (H) or (L) indicates that the assigned pin is tied high or low, respectively. An (H) indication indicates a STOP bit, an (L) indication defines a START bit, and an (L)* indication designates an unused bit tied low.

The output control circuit 650 includes two four bit counters 960 and 962. These four bit counters are available as Model No. CD40160BF and are available from RCA. Each counter receives the 600 Hz oscillator clock over line 702 from the reference clock 700 at its clock CL input. Each counter is cleared CR by lead 726 from channel CH1 of the control logic 720. The output of counter 960, as mentioned, is a 15 Hz enabled pulse appearing on line 906 which is delivered through an inverter 964 to become one input of NAND gate 966. The output of NAND gate 966 is delivered through inverter 968 to provide on lead 652*a* a 300 Hz burst clock pulse (i.e., curve 1000 on FIG. 10) to shift register 950, 952, 954 of the output register 670. As will be subsequently discussed, this provides the serial transmission rate for the output register 670. The burst is caused by the selective activation of NAND gate 966 by counter 960 over lead 970. The signals on line 974 provides control for the counters 960 and 962 to reload (jam) their respective input lines in order to obtain the burst signal (waveform 1000 of FIG. 10) and the 15 Hz pulse (waveform 1010).

Finally, gates 980, 982 and 984 operate as follows. The input to inverter 980 is delivered over line 726 from channel CH1 of the control logic 720 and forms one input of NOR gate 982. The second input to NOR gate 982 is line 633 from the address counter 630. The output of NOR gate 982 is delivered through inverter 984 to the parallel to serial (PS) input of shift registers 950, 952, 954. A high signal on this lead loads the shift register from memory over leads 662 and a low signal on this lead causes the shift register to shift the information in a serial fashion out.

The operation of the control circuit 620 shown in FIGS. 7 and 8 has been priorly set forth to result in a state table shown in Table 3.

The WRITE mode of operation will be discussed first. In Table 3, the first logic state CBA=000 produces the following values for chanels CH0-CH3:1011. Hence, channel CH0 (lead 724) is high and resets RS counter 904. Channel CH1 (lead 726) is low causing counters 960 and 962 in the output control 650 to reset. Channel CH2 (lead 728) is high which places the RAMS 920, 922, 924 in the READ state. Upon completion of this logic state, the next state CBA=001 is entered. In this state, it is desired to write all zeroes into the memory 660. Hence, channel CH0 (lead 724) becomes low which activates address counter 904 to commence counting upwardly (i.e., incrementing the address). Counter 930, at this time, is reset to zero and all zeroes are loaded into each address location in RAMS 920, 922, and 924. Channel CH1 (lead 726) becomes high to allow the 15 Hz signal to begin and channel CH2 (lead 728) goes low. The low on lead 728 is the command for WRITE. Hence, in this logic state, the counter 904 is sequenced through each address location of the RAMS 920, 922, and 924 and the zero output of counter 930 is written into each location. The logic state then enters the CBA=011 state which is the start function. Channel CH0 (lead 724) goes low which resets the address counter back to zero and channel CH2 (lead 728) also remains low to put the RAMS 920, 922, and 924 in the WRITE mode. It is to be noted that channel 3, at this time, also goes low on lead 722 which starts the delay clock circuit 710 or subsequent activation of the relay. Hence, the housing of the present invention as shown in FIGS. 1 through 3 is lowered into the bore hole and placed on the bottom. The relay is activated and the basket is opened to allow the housing to go upwardly with the flow of the fluid from the formation.

As previously discussed, as each marker 70 is passed, the pulse 680 is detected which causes the counter 904 to be incremented to the next address in memory 660 and the number of pulses appearing on lead 704 from the reference clock 700 is counted in counter 930 and at the detection of the next pulse 680, the value from the counter 930 is loaded into that specific location in memory 660. In this fashion, the actual time between detection of magnetic marker 70 is permanently stored and recorded in memory 660. In other words, the invention stays in the WRITE mode in the START function as set forth by the state of CBA=011.

In the READ mode, as set forth in Table 3, the present invention is removed from the bore hole and the switch 606 is activated to set the device in the READ mode. At the outset, it is noted that channel CH3 which controls the delay clock 710 and, therefore, relay 612 is always held in the high state. Likewise, channel CH2 (on lead 728) is always held in the high state which indicates the READ function. Logic states CBA=110 and 111 each represent a no operational state. Hence, with CBA equal to 100, channel CH1 (lead 726) goes low causing the output of gate 984 to go high thereby activating the shift registers 950, 952, and 954 from the parallel input from memory 660 state to the serial output state. Likewise, channel CH0 (lead 724) goes high which resets counter 904. Hence, the address counter 630 is reset to zero and the output register 670 is activated to the parallel serial mode. In the next state of CBA=101, channel 0 on lead 724 goes low by enabling counter 904 and signal on channel 1 (lead 726) goes high. The high signal causes the output of 984 to go low thereby activating the shift registers 950, 952, 954 into the parallel serial mode of operation. Hence, in this mode, the information can be read from the output register 670 and the memory 660 into the computer.

Figure 10:
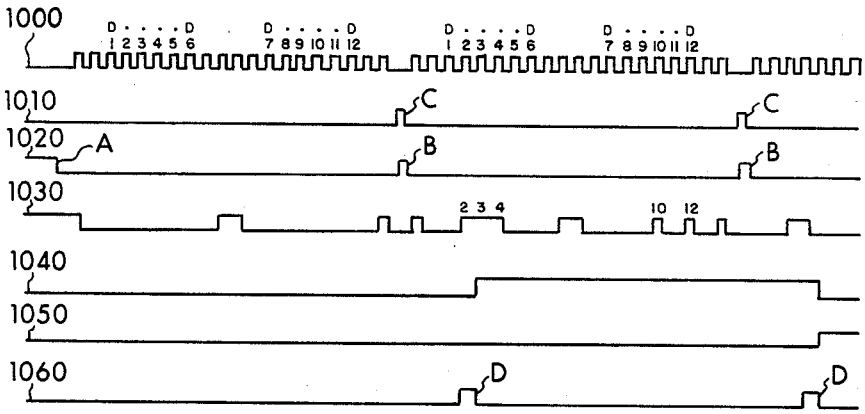
FIG. 10 is a timing diagram for the READ function of the present invention.

The READ timing diagram is set forth in FIG. 10. As mentioned, in this READ mode of operation, signal on lead 726 (CH1) goes from a low to a high state. This causes the parallel to serial (PS) input on shift registers 950, 952, 954 to become activated at point A on curve 1020. This synchronizes the system and causes the first word to be read out in serial form to be irrelevant. The system commences the reading of the data in the memory 660 when pulse B is detected on curve 1020. Simultaneous with the appearance of pulse B is pulse C on curve 1010 which represents the memory enable pulse appearing on line 633. The negative edge of pulse C latches the address. Hence, during the occurrence of pulse B in wave 1020 which appears on lead 652B, during the high level, a parallel load of the output register 670 occurs and during the low level of wave form 1020, the contents of the output register 670 are serially delivered out over line 602. Pulse B is slightly wider during its high state than pulse C so that the memory 660 has time to latch in the new address and output data delivered on the bus for loading into the shift registers. The 300 Hz. burst 1000 are the clock pulses delivered on line 652B which causes the actual serial shifting of the data from the output register 670 to occur. An example of data appearing on line 602 is shown by curve 1030. The data pulses (D1 through D12) are shown on curve 1000 and correspond to the positions set forth in Table IV. In the first data period shown in curve 1030 of FIG. 10, the data is comprised of all zeroes. In the second data period shown in curve 1030, the data is 011100000101.

As mentioned, address in counter 904 must be incremented and this occurs with pulse C on curve 1010 which appears on lead 906. It is to be noted that the time delay between pulses B and D is the eight cycle delay earlier discussed. Hence, pulse D causes the address counter to increment to the next address so that the data contained at that address will be ready to be loaded in parallel form into the output register 670 upon the appearance of next pulse B.

The data produced by the system in a 5½ inch casing and method of the present invention utilizing markers, for example, located at one foot intervals could be of the form:

TABLE V

| Depth (Feet) | Elapsed Time (Sec) |
|---|---|
| 7708 | 13 |
| 7709 | 14 |
| 7710 | 16 |
| 7711 | 15 |
| 7712 | 16 |
| 7713 | 16 |
| 7714 | 17 |
| 7715 | 19 |
| 7716 | 20 |

The raw data can be refined to show incremental flow and flow rate for the above:

TABLE VI

| Depth (Feet) | Incremental Flow (BBD) | Flow Rate (BBD) |
|---|---|---|
| 7708 | 10.5 | 147.4 |
| 7709 | 17.1 | 136.9 |
| 7710 | 7.9 | 119.8 |
| 7711 | 7.9 | 127.7 |
| 7712 | 0.0 | 119.8 |
| 7713 | 7.1 | 119.8 |
| 7714 | 11.9 | 112.7 |
| 7715 | 5.0 | 100.8 |
| 7716 | | 95.8 |

While the present invention has been described in a preferred embodiment, it is to be expressly understood that changes may be made to both the system and the method which will still be within the scope and coverage of the appended claims herewith.

I claim:

1. A bore hole flow measurement system for determining the flow of fluids (120) moving upwardly in a bore hole (20) from an underlying formation, said system comprising:

a line (40) having a plurality of spaced markers (70) located at predetermined distances (d) along said line, said line being oriented in said bore hole so that the lower end is located below said underlying formation, means (110) slidably engaging said line (40) for selectively restricting said bore hole, and means (90) connected to said restricting means (110) and slidable over said line (40) for moving upwardly with said fluids along said line (40) when said restricting means (110) is open, said moving means (90) not being capable of movement along said line (40) when said restricting means (110) is closed, said moving means being self-contained and impervious to said fluids and further comprising:

(a) means (612) in said moving means (90) for selectively opening said restricting means (110) after a predetermined time has elapsed, (b) means (400) in said moving means (90) for sensing each marker (70) on said line (40) as said opened restricting means (110) carries said moving means (90) upwardly along said line, and (c) means (410) in said moving means (90) and connected to said sensing means (400) for determining the amount of elapsed time between each sensed marker (70), said determining means (410) being further capable of storing said elapsed time between each successive marker (70), said stored elapsed time being proportional to said velocity of fluids between successive markers.

2. A bore hole flow measurement system for determining the flow of fluids (120) moving upwardly in a bore hole (20) from an underlying formation, said system comprising:

a line (40) having a plurality of spaced markers (70) located at predetermined distances (d) along said line, means (100) connected to the end of said line (40) for holding said line in said bore hole (20) so that one end is below said underlying formation, means (50, 60) connected to said line (40) for lowering said line (40) and said holding means (10) into said bore hole (20), means (110) slidably engaging said line (40) for selectively restricting said bore hole, means (90) connected to said restricting means (10) and slidable over said line (40) for moving upwardly along said line (40) when said restricting means (10) is open, said moving means (90) not being capable of movement along said line (40) when said restricting means (110) is closed, means (612) in said moving means (90) for selectively opening said restricting means (110) after a predetermined time has elapsed, means (400) in said moving means (90) for sensing each marker (70) on said line (40) as said opened restricting means (110) carries said moving means (90) upwardly, and means (410) in said moving means (90) and connected to said sensing means (400) for determining the amount of elapsed time between each sensed marker (70), said determining means (410) being further capable of storing said elapsed time between each successive marker (70).

3. A bore hole flow measurement apparatus for determining the flow of fluids (120) moving upwardly in a bore hole (20) from an underlying formation, said apparatus comprising:

a line (40) having spaced markers (70) located at predetermined distances (d) along said line, a weight (100) connected to the end of said line (40) for holding said line at the bottom (22) of said bore hole (20), means (50, 60) connected to said line (40) for lowering said line (40) and weight (100) into said bore hole (20), a basket (110) operatively slidable over said line (40), means (90) connected to said basket (110) and operatively slidable over said line (40) for moving upwardly along said line (40) when said basket (110) is open, said moving means (90) not being capable of movement along said line (40) when said basket (110) is closed, means (612) in said moving means (90) for selectively opening said basket (110) after a predetermined time has elapsed, means (400) in said moving means (90) for sensing each marker (70) on said line (40) as said basket (110) carries said moving means (90) upwardly, and means (410) in said moving means (90) and connected to said sensing means (400) for determining the amount of elapsed time between each sensed marker (70) said determining means (410) being further capable of storing said elapsed time between each successive marker (70).

4. A bore hole flow measurement apparatus for determining the flow of fluids (120) moving upwardly in a bore hole (20) from an underlying formation, said apparatus comprising:

a line (40) having spaced markers (70) located at predetermined distances (d) along said line, a weight (100) connected to the end of said line (40) for holding said line at the bottom (22) of said bore hole (20), means (50, 60) connected to said line (40) for lowering said line (40) and weight (100) into said bore hole (20), a basket (110) operatively slideable over said line (40), means (90) connected to said basket (110) and operatively slideable over said line (40) for moving upwardly along said line (40) when said basket (110) is open, said moving means (90) not being capable of movement along said line (40) when said basket (110) is closed, means (613) in said moving means (90) for selectively opening said basket (110) after a predetermined time has elapsed, means (400) in said moving means (90) for sensing each marker (70) on said line (40) as said basket (110) carries said moving means (90) upwardly, means (410) in said moving means (90) and connected to said sensing means (400) for determining the amount of elapsed time between each sensed marker (70) said determining means (410) being further capable of storing said elasped time between each successive marker (70), and means (604,606) for selective connection to said determining means (410) when said moving means (90) is removed from said bore hole (20) for reading said stored elapsed times between successive markers (70).

5. A bore hole flow measurement apparatus for determining the flow of fluids (120) moving upwardly in a bore hole (20) from an underlying formation, said apparatus comprising:

a line (40) having spaced markers (70) located at predetermined distances (d) along said line, a weight (100) connected to the end of said line (40) for holding said line at the bottom (22) of said bore hole (20), means (50, 60) connected to said line (40) for lowering said line (40) and weight (100) into said bore hole (20), a basket (110) operatively slideable over said line (40), means (90) connected to said basket (110) and operatively slideable over said line (40) for moving upwardly along said line (40) when said basket (110) is open, said moving means (90) not being capable of movement along said line (40) when said basket (110) is closed, means (613) in said moving means (90) for selectively opening said basket (110) after a predetermined time has elapsed, means (400) in said moving means (90) for sensing each marker (70) on said line (40) as said basket (110) carries said moving means (90) upwardly, and means (410) in said moving means (90) and connected to said sensing means (400) for determining the amount of elapsed time between each sensed marker (70) said determining means (410) being further capable of storing said elapsed time between each successive marker (70), said determining means (410) comprising:

(a) an address counter (630) for providing a unique memory address for each sensed marker (70), (b) a clock (700) for generating time pulses at a predetermined rate, (c) a data counter (640) receptive of said timing pulses from said clock (700) for counting the number of said timing pulses between said successive markers (70), (d) a memory (660) receptive of each said unique address from said address counter (630) and further receptive of said timing count from said data counter (640) for storing said count at said address for each successive marker (70), and (e) a control (620) connected to said address counter (630), said clock (700), said data counter (640), and said memory (660) for controlling the writing into memory (660) of said timing count for each successive marker (70).

6. The apparatus of claim 5 wherein said determining means (410) further comprises:

an output register (602) receptive of said stored timing count from said memory (660) for delivering said stored timing data from said moving means for each successive marker (70), and an output control (650) connected to said control (620), to said output register (602) and to said address counter (630) for controlling the reading.

7. A bore hole flow measurement apparatus for determining the flow of fluids (120) moving upwardly in a bore hole (20) from an underlying formation, said apparatus comprising:

a line (40) having spaced magnetic markers (70) located at predetermined distances (d) along said line, means (100) connected to the end of said line (40) for holding said line at the bottom (22) of said bore hole (20), means (50, 60) connected to said line (40) for lowering said line (40) and holding means (100) into said bore hole (20), means (110) operatively slidable over said line (40) for selectively restricting said bore hole, means (90) connected to said restricting means (110) and operatively slidable over said line (40) for moving upwardly along said line (40) when said restricting means (110) is open, said moving means (90) not being capable of movement along said line (40) when said restricting means (110) is closed, means (612) in said moving means (90) for selectively opening said restricting means (110) after a predetermined time has elapsed, means (400) in said moving means (90) for sensing each magnetic marker (70) on said line (40) as said restricting means (110) carries said moving means (90) upwardly, and means (410) in said moving means (90) and connected to said sensing means (400) for determining the amount of elapsed time between each sensed magnetic marker (70) said determining means (410) being further capable of storing said elapsed time between each successive marker (70), said determining means further comprising:

(a) an address counter (630) for providing a unique memory address for each sensed marker (70), (b) a clock (700) for generating time pulses at a predetermined rate, (c) a data counter (640) receptive of said timing pulses from said clock (700) for counting the number of said timing pulses between said successive markers (70), (d) a memory (660) receptive of each said unique address from said address counter (630) and further receptive of said timing count from said data counter (640) for storing said count at said address for each successive marker (70), (e) a control (620) connected to said address counter (630), said clock (700), said data counter (640), and said memory (660) for controlling the writing into memory (660) of said timing count for each successive marker (70), (f) an output register (602) receptive of said stored timing data from said memory (660) for delivering said stored timing data and from said moving means for each successive marker (70), and (g) an output control (650) connected to said control (620), to said output register (602) and to said address counter (630) for controlling the reading from memory (660) of said timing data.

8. A bore hole flow measurement apparatus for determining the flow of fluids (120) moving upwardly in a bore hole (20) from an underlying formation, said apparatus comprising:

a line (40) having spaced magnetic markers (70) located at predetermined distances (d) along said line, said line being oriented in said bore hole in the region of said underlying formation, means (110) operatively slideable over said line (40) for restricting said bore hole, means (90) connected to said restricting means (110) and operatively slideable over said line (40) for moving upwardly with the flow of said fluids along said line (40), means (400) in said moving means (90) for sensing each magnetic marker (70) on said line (40) as restricting means (110) carries said moving means (90) upwardly, means (410) in said moving means (90) and connected to said sensing means (400) for determining the amount of elapsed time between each sensed magnetic marker (70), said determining means (410) being further capable of storing said elapsed time between each successive marker (70), said elapsed time being proportional to said velocity of fluids between successive markers, and (means (604,606) for reading said stored elapsed times between successive markers (70) when said moving means is removed from said bore hole (20).

9. A bore hole flow measurement apparatus for determining the flow of fluids (120) moving upwardly in a bore hole (20) from an underlying formation, said apparatus comprising:

a line (40) having spaced magnetic markers (70) located at predetermined distances (d) along said line, said line being oriented in said bore hole in the region of said underlying formation, means (110) operatively slideable over said line (40) for restricting said bore hole, means (90) connected to said restricting means (110) and operatively slideable over said line (40) for moving upwardly with the flow of said fluids along said line (40), means (400) in said moving means (90) for sensing each magnetic marker (70) on said line (40) as restricting means (110) carries said moving means (90) upwardly, means (410) in said moving means (90) and connected to said sensing means (400) for determining the amount of elapsed time between each sensed magnetic marker (70), said determining means (410) being further capable of storing said elapsed time between each successive marker (70), said elapsed time being proportional to said velocity of fluids between successive markers, said determining means (410) further comprising:

(a) an address counter (630) for providing a unique memory address for each sensed marker (70), (b) a clock (700) for generating time pulses at a predetermined rate, (c) a data counter (640) receptive of said timing pulses from said clock (700) for counting the number of said timing pulses between said successive markers (70), (d) a memory (660) receptive of each said unique address from said address counter (630) and further receptive of said timing count from said data counter (640) for storing said count at said address for each successive marker (70), (e) a control (620) connected to said address counter (630), said clock (700), said data counter (640), and said memory (660) for controlling the writing into memory (660) of said timing count for each successive marker (70), (f) an output register (670) receptive of said stored timing data from said memory (660) for delivering said stored timing data from said moving means (90) for each successive marker (70), and (g) an output control (650) connected to said control (620), to said output register (670) and to said address counter (630) for controlling the reading from memory (660) of said timing data, and means (604,606) for reading said stored elapsed times between successive markers (70) when said moving means is removed from said bore hole (20).

10. A method for determining the velocity of fluids flowing upwardly in a bore hole (20) from an underlying formation, said method comprising the steps of:

placing a line (40) having a plurality of spaced magnetic markers (70) located at predetermined distances (d) on said line (40) in the bore hole, moving a sensor (400) upwardly along said line under the force of and at the same rate as the flow of said fluids in said bore hole, storing the amount of elapsed time between successive magnetic markers (70) in response to the detection of each marker (70) by the sensor (400), said stored time being proportional to said velocity of said fluids between successive markers (70), and reading said stored elapsed times when said sensor is removed from said bore hole.

11. A method for determining the velocity of fluids flowing upwardly in a bore hole (20) from an underlying formation, said method comprising the steps of:

spacing a plurality of markers at predetermined distances, d, along a line, holding said line in the bore hole so that the lower end of said line is below the underlying formation producing fluids, restricting the bore hole, after a predetermined time has elapsed, with a restrictor, moving said restrictor from below said producing formations and upwardly along said line in response to the flow of said fluids, sensing the passage of each of said markers with a sensor as said restrictor moves upwardly along said line, determining the amount of elapsed time between successive markers, storing the amount of elapsed time between successive markers in response to the detection of each marker, said stored time being proportional to said velocity of said fluids between successive markers, and reading all of the stored elapsed times after the removal of said sensor from the bore hole.

12. A bore hole flow measurement apparatus for determining the flow of fluids (120) moving upwardly in a bore hole (20) from an underlying formation, said apparatus comprising:

a line (40) having spaced magnetic markers (70) located at predetermined distances (d) along said line, a sensor (400), means (110) connected to said sensor (400) for moving said sensor (400) upwardly along said line at the same rate as the flow of said fluids in said bore hole, means (410) connected to said moving means (110) and to said sensor (400) for storing the amount of elapsed time between successive markers (70) in response to the detection of each marker (70) by said sensor (400), said stored elapsed time being proportional to said velocity of said fluids between successive markers (70), and means (604,606) for reading said stored elapsed times.

13. A bore hole flow measurement apparatus for determining the flow of fluids (120) moving upwardly in a bore hole (20) from underlying formations, said apparatus comprising:

a plurality of indicators (70), a line (40) having said plurality of indicators (70) located at predetermined distances (d) along said line, a self-contained housing (90) slidably engaging said line (40), said housing being impervious to said fluids at said underlying formations, and means (110) for moving said housing upwardly along said line (40) at the same rate as the flow of said fluids in said bore hole, said housing comprising:

(a) means (400) in said housing (90) for sensing the passage of each successive indicator (70) as said housing (90) moves upwardly along said line (40), and (b) means (410) in said housing (90) connected to said sensing means (400) for storing the amount of elapsed time between successive indicators (70) in response to the detection of each indicator (70) by said sensor (400), said stored elapsed time being proportional to said velocity of said fluids between successive indicators (70).

* * * * *

UNITED STATES PATENT AND TRADEMARK OFFICE

CERTIFICATE OF CORRECTION

PATENT NO. : 4,581,927

DATED : April 15, 1986

INVENTOR(S) : Irvin D. Johnson

It is certified that error appears in the above-identified patent and that said Letters Patent are hereby corrected as shown below:

| | |
|---|---|
| Col. 3, line 34: | After "timed" insert --to--. |
| Col. 4, line 21: | Delete "flaw" and insert --flow--. |
| Col. 5, line 6: | Delete "under" and insert --unit--. |
| Col. 6, line 19: | Delete "2784" and insert --2785--. |
| Col. 7, line 39: | Delete "3 1 0 1" and insert --3 2 1 0--. |
| Col. 8, line 15: | Delete "The" and insert --In--. |
| Col. 10, line 15: | Delete "register" and insert --registers--. |
| Col. 17, line 1: | Delete "(means" and insert --means--. |

Signed and Sealed this

*Fifteenth* Day of *July 1986*

[SEAL]

*Attest:*

*Attesting Officer*

DONALD J. QUIGG

*Commissioner of Patents and Trademarks*